US007903788B2

(12) United States Patent
Moore et al.

(10) Patent No.: US 7,903,788 B2
(45) Date of Patent: Mar. 8, 2011

(54) THERMIONIC EMITTER DESIGNED TO PROVIDE UNIFORM LOADING AND THERMAL COMPENSATION

(75) Inventors: Paul D. Moore, Salt Lake City, UT (US); James Russell Boye, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 342 days.

(21) Appl. No.: 12/238,200

(22) Filed: Sep. 25, 2008

(65) Prior Publication Data

US 2010/0278307 A1 Nov. 4, 2010

(51) Int. Cl.
*H01J 35/06* (2006.01)

(52) U.S. Cl. ..... 378/136; 378/121

(58) Field of Classification Search ..... 378/119, 378/121, 136; 313/305, 341
See application file for complete search history.

(56) References Cited

U.S. PATENT DOCUMENTS

2009/0323898 A1* 12/2009 Moore ..... 378/136
* cited by examiner

*Primary Examiner* — Courtney Thomas
(74) *Attorney, Agent, or Firm* — Maschoff Gilmore & Israelsen

(57) ABSTRACT

An electron emitter assembly for use in an x-ray emitting device or other electron emitter-containing device is disclosed. In one embodiment, an x-ray tube is disclosed, including a vacuum enclosure that houses both an anode having a target surface, and a cathode positioned with respect to the anode. The cathode includes an electron emitter having a plurality of substantially parallel emission surfaces that collectively emit a beam of electrons for impingement on the target anode. In one aspect, the plurality of substantially parallel emission surfaces are angled relative focusing region so as to provide a substantially uniform thermal load on the target anode. In another aspect, the electron emitter includes a plurality of cut-outs that accommodate thermal expansion in the plane of the emitter. Accommodating thermal expansion in the plane of the emitter prevents distortions to the emitter that would tend to alter the focusing of the electrons on the target anode. Providing a substantially uniform thermal load on the target anode and preventing thermal distortion of the emitter lead to higher x-ray flux and better focusing for higher quality x-ray images.

50 Claims, 5 Drawing Sheets

THERMIONIC EMITTER DESIGNED TO PROVIDE UNIFORM LOADING AND THERMAL COMPENSATION

CROSS-REFERENCE TO RELATED APPLICATIONS

U.S. patent application Ser. No. 11/942,656 entitled "FILAMENT ASSEMBLY HAVING REDUCED ELECTRON BEAM TIME CONSTANT"; U.S. Pat. No. 7,062,017 entitled "INTEGRAL CATHODE"; U.S. patent application Ser. No. 12/165,279 THERMIONIC EMITTER DESIGNED TO CONTROL ELECTRON BEAM CURRENT PROFILE IN TWO DIMENSIONS; and U.S. Patent Application entitled "ELECTRON EMITTER APPARATUS AND METHOD OF ASSEMBLY," application Ser. No. 12/238,214, filed on Sep. 25, 2008; each of which are incorporated herein by reference in their entirety.

BACKGROUND

1. The Field of the Invention

Embodiments of the present invention relate generally to electron emitters. More particularly, embodiments of the present invention relate to thermionic emission of electrons for x-ray generation.

2. The Relevant Technology

The x-ray tube has become essential in medical diagnostic imaging, medical therapy, and various medical testing and material analysis industries. Such equipment is commonly employed in areas such as medical diagnostic examination, therapeutic radiology, semiconductor fabrication, and materials analysis.

An x-ray tube typically includes a vacuum enclosure that contains a cathode assembly and an anode assembly. The vacuum enclosure may be composed of metal such as copper, glass, ceramic, or a combination thereof, and is typically disposed within an outer housing. At least a portion of the outer housing may be covered with a shielding layer (composed of, for example, lead or a similar x-ray attenuating material) for preventing the escape of x-rays produced within the vacuum enclosure. In addition a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating it to an external heat exchanger via a pump and fluid conduits. The cathode assembly generally consists of a metallic cathode head assembly and a source of electrons highly energized for generating x-rays. The anode assembly, which is generally manufactured from a refractory metal such as tungsten, includes a target surface that is oriented to receive electrons emitted by the cathode assembly.

During operation of the x-ray tube, the cathode is charged with a heating current that causes electrons to "boil" off the electron source by the process of thermionic emission. An electric potential on the order of about 4 kV to over about 200 kV is applied between the cathode and the anode in order to accelerate electrons boiled off the electron source toward the target surface of the anode assembly. X-rays are generated when the highly accelerated electrons strike the target.

Most of the electrons that strike the anode dissipate their energy in the form of heat. Some electrons, however, interact with the atoms that make up the target and generate x-rays. The wavelength of the x-rays produced depends in large part on the type of material used to form the anode surface. X-rays are generally produced on the anode surface through two separate phenomena. In the first, the electrons that strike the cathode carry sufficient energy to "excite" or eject electrons from the inner orbitals of the atoms that make up the target. When these excited electrons return to their ground state, they give up the excitation energy in the form of x-rays with a characteristic wavelength. In the second process, some of the electrons from the cathode interact with the atoms of the target element such that the electrons are decelerated around them. These decelerating interactions are converted into x-rays by conservation of momentum through a process called bremstrahlung. Some of the x-rays that are produced by these processes ultimately exit the x-ray tube through a window of the x-ray tube, and interact with a patient, a material sample, or another object.

In order to produce high-quality x-ray images it is generally desirable to maximize both x-ray flux (i.e., the number of x-ray photons emitted per unit time) and x-ray beam focusing. An intense electron beam is useful for collecting high-contrast images in as short a period of time as possible, while the ability to distinguish between different structures in an x-ray image (e.g., a cancerous mass versus surrounding healthy tissue) is limited by x-ray focusing.

X-ray flux can be increased by increasing the number of electrons emitted by the emitter that impinge on the target anode. The number of electrons emitted by the emitter is a function of the amount of electrical current passing through the emitter and the temperature of the emitter. In general, raising the current increases the temperature of the emitter, which increases the number of electrons emitted by the emitter. In turn, greater x-ray flux is produced when greater numbers of electrons strike the target surface.

While image contrast depends on electron flux, image quality (i.e., the ability to distinguish between different structures in an x-ray image) is a function of the focal pattern, or focal spot, created by the emitted beam of electrons on the target surface of the target anode. In general, a smaller focal spot produces a more highly focused or collimated beam of x-rays, which in turn produces better quality x-ray images. This phenomenon can readily be analogized to the shadows produced by a visual light source. For example, the shadows cast by a sharp light source (e.g., a point source such as a laser) are themselves sharp, while the shadows cast by a poorly defined light source (e.g., fluorescent office lights) are themselves poorly defined and diffuse. The same is true of the shadows cast by the x-rays that are transmitted and absorbed as x-rays pass through a subject.

Nevertheless, the desire to maximize electron flux and the desire to maximize electron beam focusing are often at odds with one another. For example, raising the temperature of the emitter to increase electron beam flux can cause the shape of the emitter to change, which can adversely affect electron beam focusing. In extreme cases, increasing the amount of current passing through the emitter can damage the emitter leading to failure of the x-ray device.

Another important consideration in the design of x-ray devices is the physical limits of the anode. As mentioned above, the majority of the electrons that impinge on the target anode dissipate their energy in the form of heat rather than generating x-rays. In order to maximize x-ray flux, it is generally necessary to apply the maximum possible power to the emitter, which heats the anode to its physical limits. A lack of homogeneity in anode heating produced by the electron beam will limit the amount of power that can be applied to the x-ray device and limit the x-ray flux that can be obtained. Anode overheating and electron beam inhomogeneity are usually alleviated—but not eliminated—by rotating the anode at high speed.

BRIEF SUMMARY OF EXAMPLE EMBODIMENTS

Embodiments of the present invention are directed to a thermionic emitter used to emit electrons for the production of x-rays. In particular, the emitter is designed to produce a substantially uniform heat profile on a target anode and/or alleviate or eliminate heat-induced distortion of the emitter. Producing a substantially uniform thermal profile on the target anode and/or alleviating or eliminating heat-induced distortion of the emitter allows for the generation of maximum electron and x-ray flux, while simultaneously producing well-focused, high-quality x-rays.

One example embodiment includes an electron emitter assembly designed to produce a substantially uniform thermal profile on a target anode. In one embodiment, the electron emitter assembly includes a cathode head, a focusing apparatus operatively coupled to the cathode head that includes a focusing aperture having at least first and second side edges, and an electron emitter. The electron emitter is disposed in the cathode head relative to the focusing apparatus and the focusing aperture such that the focusing aperture focuses a cloud of electrons emitted by the electron emitter into an electron beam.

The electron emitter is typically a refractory metal conduction element having a plurality of substantially parallel electron emission surfaces. Suitable examples of refractory metal conduction elements include, but are not limited to, metal foils and helical wires. In one embodiment, the refractory metal conduction element is a refractory metal foil having a plurality of electron-emitting rungs defined by a plurality cut out slits, each rung having a middle portion and two end portions, the middle portion having a relatively wider cross-section than the end portions. The cross-section of each rung is selected to balance current flow, resistance, and thermal conduction such that a beam of electrons is collectively emitted from the rungs. In another embodiment, the refractory metal conduction element is a wire filament. Suitable examples of wire filaments include, but are not limited to, helically coiled wire filaments and bent wire filaments.

While electron emitters having a plurality of substantially parallel electron emission surfaces are commonly used in the industry because of their ease of fabrication and installation, they tend to produce a banding pattern on the target anode that adversely affects operation of the x-ray device. The banding is produced because the emitter is typically positioned above the target anode with the parallel emission surfaces parallel to the direction of rotation of the anode. The adverse effects produced by the banding are further exacerbated by the presence linearly separated hotter regions or "hot spots" on each parallel emission surface of the emitter. In the typical configuration described above, overlap and add together on top of the band pattern. This banding effect adversely affects the focusing of the electron beam on the target anode, and perhaps more significantly, the additive effect of the hotspots reduces the maximum power rating and the maximum x-ray flux of the x-ray tube because of the heat limits of the target anode.

In one embodiment of the present invention, the electron emitter is configured to significantly alleviate or eliminate these banding and additive effects. As such, in one embodiment, the parallel emission surfaces are angled relative to the focusing aperture. Angling the parallel emission surfaces produces a substantially uniform thermal profile on the target anode by essentially widening the area of the rotating anode that is heated by each of the parallel emission surface, which alleviates or eliminates the banding, and by reducing or eliminating the additive heating effect by offsetting the hot spots so that they do not overlap. Angling the parallel emission surfaces relative to the anode surface has surprising and unexpected results in terms of increasing the maximum power rating of the x-ray generator, which increases x-ray flux and in terms of x-ray quality (i.e., a balancing of x-ray focusing and x-ray flux).

In the case of a foil emitter, the substantially parallel emission rungs are angled relative to an x-axis defined by at least one of the side edges of the foil. The foil emitter is typically disposed in the cathode head such that angle defined by the rungs and the side of the foil is consistent or the same as the angle defined by the focusing aperture.

Selection of an angle needed to significantly alleviate or eliminate the banding pattern and/or hot spot overlap will vary depending on the design of the emitter. That is, the desired angle is a function of the length of the emission region on each of the parallel emission surfaces, liner distance between the hot spots on each emitting surface, and the vertical distance between adjacent emitting surfaces. Preferably, the angle is in a range from about 5° to about 45°. More preferably, the angle is in a range from about 7.5° to about 35°. Even more preferably, the angle is in a range from about 10° to about 25°. Most preferably, the angle is in a range from about 10° to about 15°.

It is important to note, however, that the effect of angling the plurality of substantially parallel emission surfaces relative to the focusing aperture and/or at least one side edge of the foil cannot simply be achieved by rotating the cathode head relative to the anode surface. The cathode head is installed in an x-ray tube so that the long axis of the focusing aperture is aligned parallel to a radial line drawn from the center of the anode that bisects the long axis of the focusing aperture. This radial line is referred to as the central ray. If the cathode head is rotated so that the long axis of the focusing aperture is no longer aligned with the central ray, the focal spot will also rotate on the anode surface. This causes the focal spot to become trapezoidal and appear skewed. This is undesirable from an imaging standpoint because it produces poorly focused x-ray that vary in intensity across the focal region.

Since the whole cathode head cannot be rotated without resulting in undesirable skew in the focal spot, emitter disclosed herein angles plurality of parallel emission surfaces with respect to the plane of rotation of the target to provide for a substantially uniform thermal load on the target anode. This allows the maximum power to be applied to the anode producing maximum x-ray flux without resulting in thermal damage to the anode. A second effect is that the line shape function of the focal spot is also smoothed leading to a more desirable Modulation Transfer Function for better x-ray focusing and sharper x-ray images.

Electron emitters also have a tendency to sag or distort in response to the heating of the electrical conduction element necessary for electron emission. Heat-induced distortion or sagging adversely affects the focusing of the electron beam on the target anode, which adversely affects x-ray quality. In one embodiment, the emitter is a refractory metal foil that includes a plurality of ellipsoidal cut-outs positioned adjacent to the edges of the emitter and at the ends of the rungs. The ellipsoidal cut-outs are able to accommodate heat-induced expansion of the emitter such that the refractory metal foil remains substantially flat in operation.

The plurality of rungs form a serpentine electrical conduction path wherein the rungs are electrically connected to one another in series. In one embodiment, the ellipsoidal cut-outs are substantially isolated from the electrical conduction path so that essentially no current passes through the thin members that connect the ellipsoidal cut-out region to the rungs.

In one embodiment, the present invention includes an x-ray tube. The x-ray tube includes a vacuum enclosure, an anode positioned within the vacuum enclosure and including a target surface, and an electron emitter assembly positioned with respect to the anode. The electron emitter assembly includes a cathode head, a focusing aperture operatively coupled to the cathode head, the focusing aperture having first and second side edges, and a substantially flat electron emitter disposed in the cathode head relative to the focusing apparatus such that the focusing apparatus focuses the electrons emitted by the electron emitter into an electron beam that impinges on the target surface for generation of x-rays. The electron emitter is a refractory metal foil having first and second edges and a plurality of rungs defined by a plurality of slits cut out of the refractory metal foil. The rungs define an x-axis angle in a range from about 5° to about 45° relative to at least one of the edges the foil. The emitter is installed in the cathode head such that the rung angle is also defined relative to the focusing aperture. As discussed in more detail above, the angling provides for a substantially uniform heat profile on the target anode under impingement by the electron beam.

One embodiment of the present invention includes an x-ray imaging device. The x-ray imaging device includes an x-ray detector, and an x-ray source. The x-ray source includes a vacuum enclosure, an anode positioned within the vacuum enclosure and including a target surface, and an electron emitter assembly positioned with respect to the anode. In particular, the electron emitter assembly is configured as previously described so as to provide for a substantially uniform heat profile on the target anode under impingement by the electron beam.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXAMPLE EMBODIMENTS

Embodiments of the present invention are directed to a thermionic emitter used to emit electrons for the production of x-rays. In particular, the emitter is designed to produce a substantially uniform heat profile on a target anode and/or alleviate or eliminate heat-induced distortion of the emitter. Producing a substantially uniform thermal profile on the target anode and/or alleviating or eliminating heat-induced distortion of the emitter allows for the generation of maximum electron and x-ray flux, while simultaneously producing well-focused, high-quality x-rays.

I. X-Ray Devices

Figure 1:
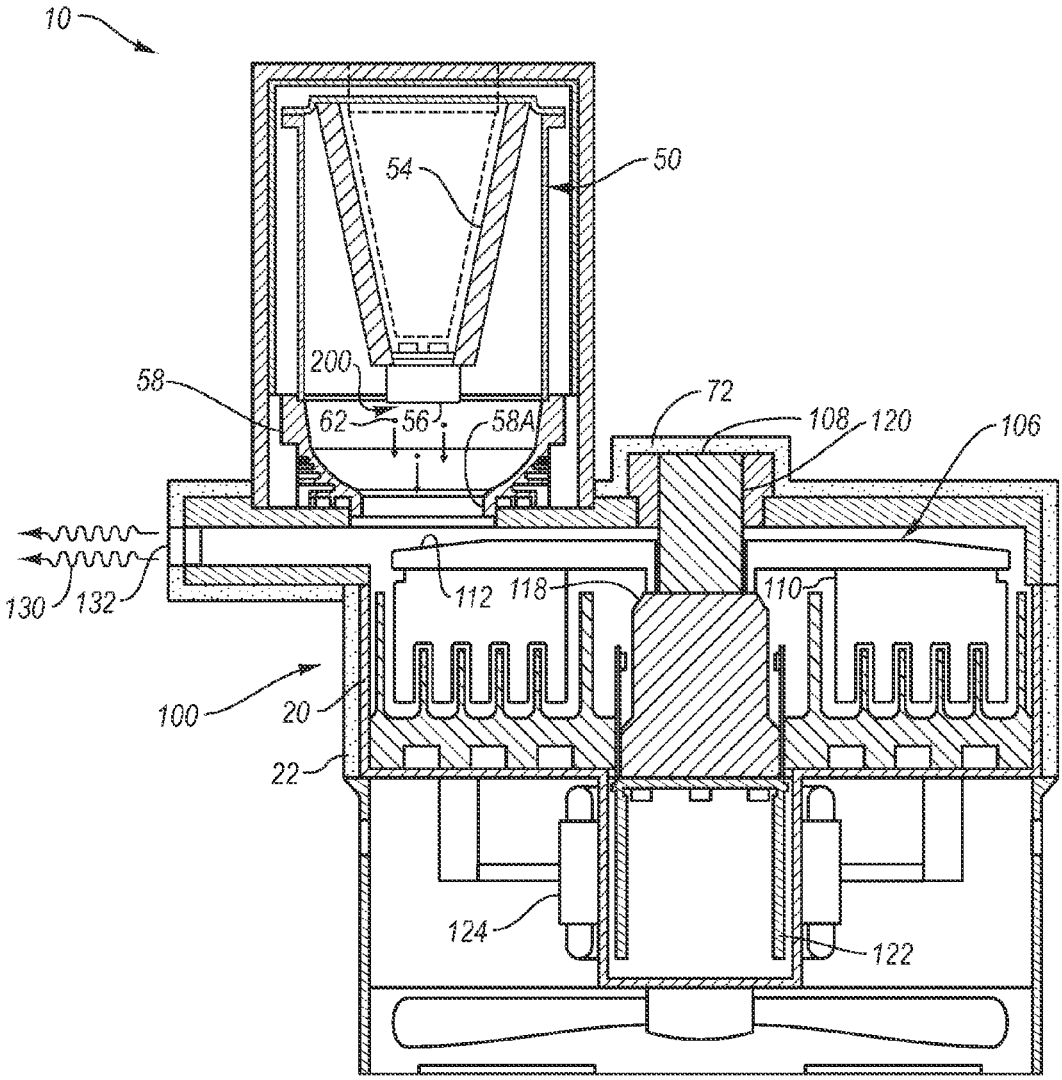
FIG. 1 illustrates a cross sectional side view of an x-ray tube that serves as one possible environment for inclusion of the present invention, according to one embodiment.

Reference is first made to FIG. 1, which depicts one possible environment wherein embodiments of the present invention can be practiced. Particularly, FIG. 1 shows an x-ray tube, designated generally at 10, which serves as one example of an x-ray generating device. The x-ray tube 10 generally includes an evacuated enclosure 20 that houses a cathode assembly 50 and an anode assembly 100. The evacuated enclosure 20 defines and provides the necessary envelope for housing the cathode and anode assemblies 50, 100 and other critical components of the tube 10 while providing the shielding and cooling necessary for proper x-ray tube operation. The evacuated enclosure 20 further includes shielding 22 that is positioned so as to prevent unintended x-ray emission from the tube 10 during operation. Note that, in other embodiments, the x-ray shielding is not included with the evacuated enclosure, but rather might be joined to a separate outer housing that envelops the evacuated enclosure. In yet other embodiments, the x-ray shielding may be included neither with the evacuated enclosure nor the outer housing, but in another predetermined location.

In greater detail, the cathode assembly 50 is responsible for supplying a stream of electrons for producing x-rays, as previously described. While other configurations could be used, in the illustrated example the cathode assembly 50 includes a support structure 54 that supports a cathode head 56. In the example of FIG. 1, a cathode aperture shield 58 defines an aperture 58A that is positioned between an electron emitter assembly, generally designated at 200 and described in further detail below, and the anode 106 to allow electrons 62 emitted from the electron emitter assembly to pass. The aperture shield 58 in one embodiment can be cooled by a cooling fluid as part of a tube cooling system (not shown) in order to remove heat that is created in the aperture shield as a result of errant electrons impacting the aperture shield surface. FIG. 1 is representative of one example of an environment in which the disclosed filament assembly might be utilized. However, it will be appreciated that there are many other x-ray tube configurations and environments for which embodiments of the filament assembly would find use and application.

As mentioned, the cathode head 56 includes the electron emitter assembly 200 as an electron source for the production of the electrons 62 during tube operation. As such, the electron emitter assembly 200 is appropriately connected to an electrical power source (not shown) to enable the production by the assembly of the high-energy electrons, generally designated at 62.

The illustrated anode assembly 100 includes an anode 106, and an anode support assembly 108. The anode 106 comprises a substrate 110 preferably composed of graphite, and a target surface 112 disposed thereon. The target surface 112, in one example embodiment, comprises tungsten or tungsten rhenium, although it will be appreciated that depending on the application, other "high" Z materials/alloys might be used. A predetermined portion of the target surface 112 is positioned such that the stream of electrons 62 emitted by the electron emitter 200 and passed through the shield aperture 58A impinge on the target surface so as to produce the x-rays 130 for emission from the evacuated enclosure 20 via an x-ray transmissive window 132.

The production of x-rays described herein can be relatively inefficient. The kinetic energy resulting from the impingement of electrons on the target surface also yields large quantities of heat, which can damage the x-ray tube if not dealt with properly. Excess heat can be removed by way of a number of approaches and techniques. For example, in the disclosed embodiment a coolant is circulated through designated areas of the anode assembly 100 and/or other regions of the tube. Again, the structure and configuration of the anode assembly can vary from what is described herein while still residing within the claims of the present invention.

In the illustrated example, the anode 106 is supported by the anode support assembly 108, which generally comprises a bearing assembly 118, a support shaft 120, and a rotor sleeve 122. The support shaft 120 is fixedly attached to a portion of the evacuated enclosure 20 such that the anode 106 is rotatably disposed about the support shaft via the bearing assembly 118, thereby enabling the anode to rotate with respect to the support shaft. A stator 124 is circumferentially disposed about the rotor sleeve 122 disposed therein. As is well known, the stator utilizes rotational electromagnetic fields to cause the rotor sleeve 122 to rotate. The rotor sleeve 122 is attached to the anode 106, thereby providing the needed rotation of the anode during tube operation. Again, it should be appreciated that embodiments of the present invention can be practiced with anode assemblies having configurations that differ from that described herein. Moreover, in still other tube implementations and applications, the anode may be stationary.

II. The Electron Emitter

Figure 2A:
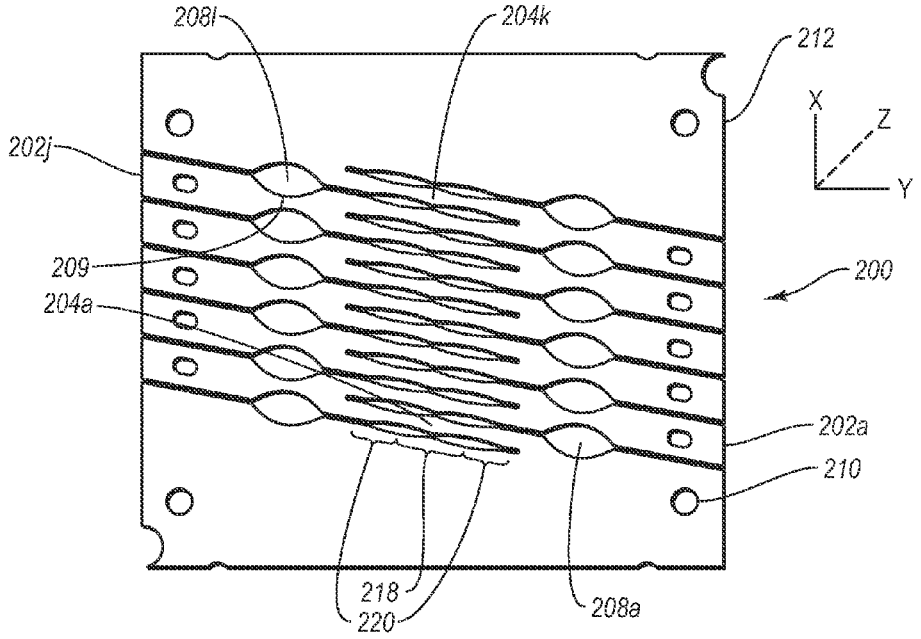
FIG. 2A illustrates a view of a foil electron emitter, according to one embodiment of the present invention.
Figure 2B:
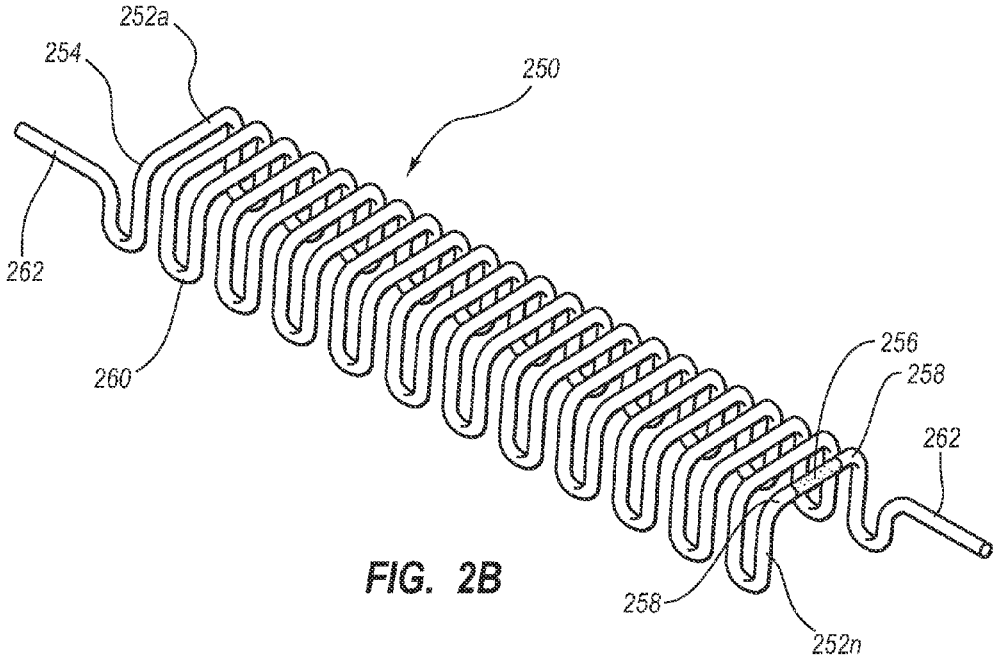
FIG. 2B illustrates a view of a filament electron emitter, according to one embodiment of the present invention.

Attention is now directed to FIGS. 2A and 2B, wherein further details concerning embodiments of the electron emitter are given. FIGS. 2A and 2B depict exemplary electron emitters 200 and 250 according to the present invention.

As discussed in the previous section, the x-ray tubes that are included in x-ray devices typically include a cathode 56 that serves as a source of electrons 62 for the generation of x-rays 130. In most applications, the cathode includes an electron emitter that includes a plurality of substantially parallel thermionic emission surfaces that emit or "boil off" electrons in response to a heating electrical current. The emitted electrons 62 are focused for impingement on to the target surface 112 of a target anode 106 for the generation of x-rays 130.

The electrons are focused into a focal spot on the target surface 112 of the target anode 106. The focal spot produced by an emitter having a plurality of substantially parallel emission surfaces will tend to produce bands on the anode surface. Such banding results in non-uniform thermal loading on the target surface 112, which limits the peak power that can be applied to the anode without resulting in thermal damage. It is desirable from both a thermal loading standpoint and an imaging standpoint to alleviate or eliminate this banding and produce a more uniform electron beam intensity on the target surface 112.

Emitters having a plurality parallel emission surfaces, such as emitters 200 and 250, also tend to have a pair of hotter regions or "hot spots" on each of the parallel emission surface of the emitter. When the electron emitter emits electrons for impingement on a target surface 112, these hot spots project onto the target surface. Because the anode is rotating at a high rate of speed and the emission surfaces are typically arranged parallel to the direction of rotation of the anode, the hot spots overlap and the heat adds together to form a series of hot stripes on the target surface 112 rotating anode 106. Instead of producing the desired uniform heat profile on the on the target surface 112, overlap of these hot spots severely limits the heat rating of the x-ray device and limits potential x-ray flux.

The electron emitter depicted in FIG. 2A is a refractory metal foil emitter configured to emit electrons when the refractory metal foil is electrically energized. Electron emitter 200 includes a plurality of end segments 202, and a plurality of rung segments 204. Rung segments 204 form a plurality of substantially parallel electron emission surfaces configured for the emission of electrons (denoted at 62 in FIG. 1) during tube operation. In the illustrated embodiment, the electron emitter assembly 200 includes a plurality end segment 202*a*-202*j* and a plurality of rung segments 204*a*-204*k*, though it is appreciated that in other embodiments, more or fewer end and rung segments can be included in the electron emitter assembly 200. Each of rung segments 204*a*-204*k* includes an electron-emitting central portion 218 bounded by two adjacent non-emitting portions 220.

As can be seen in FIG. 2A, rung segments 204*a*-204*k* are angled relative to an x-axis defined by one of the side edges 212 of the emitter. While the side edge that defines the x-axis is labeled at 212, one will of course appreciate that any side edge of emitter 200 can be used to define an x-axis. As will be explained in greater detail below, angling rung segments 204*a*-204*k* relative to the x-axis defined by side edge 212 is one way are to alleviate or eliminate the banding pattern associated with emitters having a plurality of substantially parallel electron emission surfaces (i.e., rungs 204*a*-204*k*).

Selection of an angle needed to significantly alleviate or eliminate the banding pattern and/or hot spot overlap will vary depending on the design of the emitter. That is, the angle is a function of the liner distance between the hot spots on each emitting surface and the vertical distance between adjacent emitting surfaces. Preferably, the angle is in a range from about 5° to about 45°. More preferably, the angle is in a range from about 7.5° to about 35°. Even more preferably, the angle is in a range from about 10° to about 25°. Most preferably, the angle is in a range from about 10° to about 15°.

The electron emitter 200 depicted in FIG. 2A also includes a plurality of ellipsoidal cut-outs 208*a*-208*l* that are able to accommodate thermal expansion such that the shape of emitter 200 does not change during operation. Because changing the shape of the emitter 200 adversely affects focusing of the emitted electrons, it is desirable to significantly alleviate or eliminate shape changes in emitter 200 caused by thermal expansion.

Electron emitters such as emitter 200 emit electrons in response to flow of a heating electrical current. For example, electron emission from a tungsten emitter occurs in a relatively narrow temperature band from about 2100° C. to the saturation point at about 2500° C. where increases in temperature do not appreciably increase electron emission. At temperatures such as these, shape changes caused by thermal expansion of the emitter material can cause emitter 200 to distort or sag, which in turn affects focusing.

In the example electron emitter depicted in FIG. 2A, the ellipsoidal cut-outs 208*a*-208*l* are positioned on the emitter 200 between the sides and the ends of rungs 204. Forming the ellipsoidal cut-outs in emitter 200 leaves a plurality of thinner regions 209*a*-209*j* between cut-outs 208*a*-208*l*.

It should be noted that forming cut-outs 208*a*-208*l* in emitter 200 does not eliminate thermal expansion. Rather, cut-outs 208*a*-208*l* allows the emitter to expand in the plane of the emitter as opposed to causing bowing or sagging above or below the plane of the emitter. It is believed, for example, that the expansion is absorbed into the plane of the emitter because the thinner regions 209*a*-209*j* allow the rungs 204*a*-204*k* to pivot into the space left by the ellipsoidal cut-outs 208*a*-208*l*.

Reference is now made to FIG. 2B in describing an electron emitter according to another embodiment of the present invention. In particular, an electron emitter 250 is shown, having a plurality of filament segments 252*a*-252*n* integrally defined by an elongate conductive member 254, such as a thoriated tungsten wire, and arranged parallel to one another in a "ladder"-type configuration. Each of filament segments 252*a*-252*n* includes an electron-emitting central portion 256 bounded by two adjacent end portions 258. The filament segments 252*a*-252*n* are interconnected to one another by bent interconnecting portions 260 of the conductive member 254. As such, the interconnecting portions are considered part of the filament segments 252*a*-252*n*. Each end of the conductive member 254 defines a terminal 262 for electrically connecting the filament assembly 250 to a power source (not shown).

Electron emitters are coupled to an electrical power source (not shown) so as to stimulate emission of electrons. In the depicted embodiments, the emission segments 204*a*-204*k* and 252*a*-252*n* are electrically connected in series, though it is appreciated that the emission segments can be connected in parallel in other embodiments. Typically, the operational current for an electron emitter assembly that is connected in series is in a range of about 3 amps to about 10 amps. If the electron emitter assembly 200 is connected in parallel, the operation current is typically in a range from about 30 amps to about 50 amps.

So configured, the emission segments in the depicted embodiments 204*a*-204*k* and 252*a*-252*n* operate simultaneously in producing electrons during tube operation. During such operation, the central portion 218 or 256 of each emission segment produces electrons via thermionic emission. The overall shape and configuration of the electron emitter assembly provides for sufficient heat buildup in the central portion 218 or 256 of each emission segment for thermionic emission, while the end portions 220 and 258 are relatively cooler.

Reference is now made to Equation 1:

$$\text{mA electrons emitted per square millimeter} = AT^2e^{-(\Phi/kT)} \quad \text{(Equation 1)}$$

A is a constant equal to $20\times10^6$ mA/mm$^2$K$^2$. Φ, which is referred to as the work function, is the minimum energy (measured in electron volts) needed to remove an electron from a solid to a point immediately outside the solid surface. The work function for a given electron emitter is unique to the material or materials that the emitter is fabricated from. k is Boltzman's constant and is equal to $8.62\times10^{-5}$ eV/K. T is the temperature of the electron emitter in Kelvin. For example, for tungsten the work function value is Φ=4.55 eV. Work function values are known or can be determined for other materials using known methods.

In one embodiment of the present invention, it may be desirable to alter the work function value of the electron emitter to affect electron emission. For example, it may be desirable to fabricate the electron emitter using thorium doped tungsten (i.e., thoriated tungsten), which has a work function value of about 2.7 eV versus 4.55 eV for pure tungsten. A lower work function value means, for example, that an electron emitter fabricated from thoriated tungsten will emit electrons more readily than a material with a higher work function value, such as tungsten. One will therefore appreciate that altering the work function value of the material used to fabricate the electron emitter assembly is one way that electron emission from the emitter can be controlled. Other possible materials might include, for example, tungsten-rhenium, lanthanated tungsten, hafnium, hafnium carbide, and combinations of these or similar materials.

In one embodiment of the present invention, the refractory metal further includes a carbon dopant. Carbon doping or carburization of a refractory metal electron emitter is typically achieved by subjecting the completed electron emitter to a heat treatment in a hydrocarbon atmosphere consisting of a hydrogen carrier gas and benzene, naphthalene acetylene, or xylene. When the electron emitter is heated in the presence of the hydrocarbon to a temperature on the order of 2000° C., the hydrocarbon is decomposed at the hot surface to form a carbide that diffuses into the refractory metal. Inclusion of the carbon dopant alters the work function of the refractory metal, which alters the temperature-dependent electron emission profile of the emitter. In addition carburization significantly increases the useful lifespan of an electron emitter assembly fabricated from a thoriated refractory metal by reducing the rate of thorium evaporation from the emitter.

As can be appreciated from Equation 1, electron emission from the electron emitter is highly dependent on the temperature of the electron emitter. For example, appreciable increases in electron emission from tungsten occurs in a relatively narrow temperature range from about 2100° C. to the saturation point at about 2500° C. where increasing the temperature further will no longer increase electron flux. One can also appreciate from Equation 1 that electron emission drops by about a factor of 2 for about every 80° C. in temperature drop.

Figure 3A:
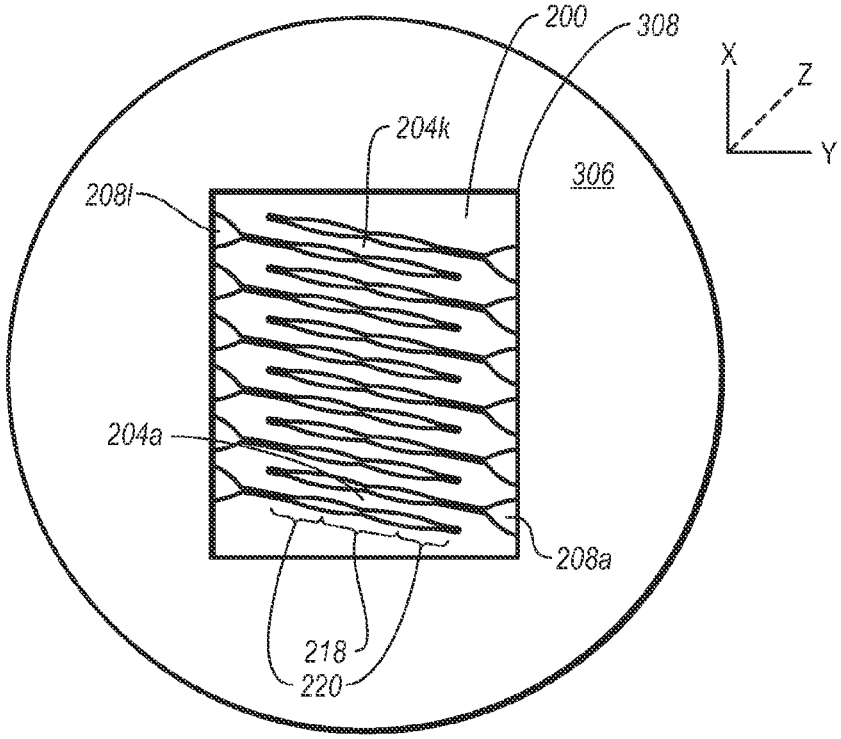
FIG. 3A illustrates a foil electron emitter and a focusing aperture, according to one embodiment of the present invention.
Figure 3B:
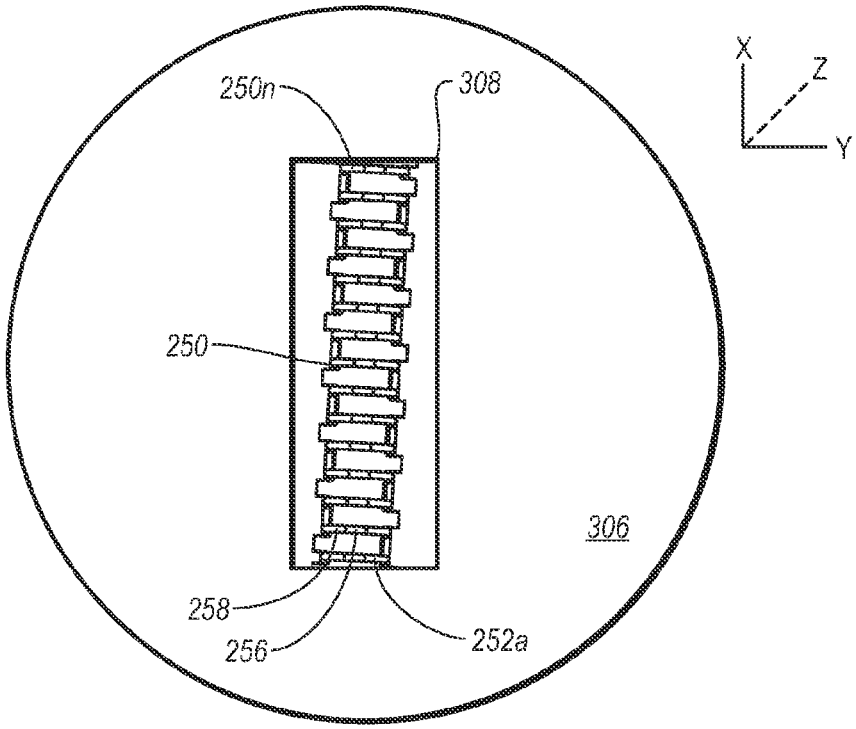
FIG. 3B illustrates a filament electron emitter and a focusing aperture, according to one embodiment of the present invention.

Reference is now made to FIGS. 3A and 3B. FIG. 3A illustrates the relationship between an exemplary foil electron emitter 200 like the one depicted in FIG. 2A and cathode top 306 having a focusing aperture 308. Electron emitter 200 includes a plurality of substantially parallel electron emission rungs 204*a*-204*k* and a plurality of ellipsoidal cut-outs 208*a*-208*l*.

When installed in an x-ray tube, electron emitter 200, cathode top 306 and the other parts of the cathode head (depicted generally at 56 in FIGS. 1 and 4) are connected to a high-voltage power supply (not shown). While only the emitter 200 carries current, emitter 200 and the cathode head 56 including cathode top 306 collectively generate an electrical potential field that acts to overcome the mutual repulsion of the electrons and focus the emitted electrons into a beam that impinges on the anode in order to generate x-rays.

FIG. 3B illustrates the relationship between an exemplary filament emitter 250 like the one depicted in FIG. 2B and cathode top 306 having a focusing aperture 308. Electron emitter 250 includes a plurality of substantially parallel electron emission rungs 252*a*-252*n*.

To a large extent, the shape of the beam emitted by emitters 200 and 250 is dictated by the size and shape of the focusing aperture 308. As discussed in more detail above, the focusing aperture 308 situated above the target surface such that the long axis of the window is parallel to the central ray defined by a radial line of the rotating anode. In the examples depicted in FIGS. 3A and 3B, the substantially parallel emission surfaces (i.e., 204*a*-204*k* or 252*a*-252*n*) are angled relative to a vertical x-axis defined by focusing aperture. In the embodiment depicted in FIG. 3A, the angle relative to the focusing aperture is the same as the angle with respect to the side edge of the foil described in relation to FIG. 2A. One will appreciate, however, that in other embodiments the angles could be different.

Figure 4:
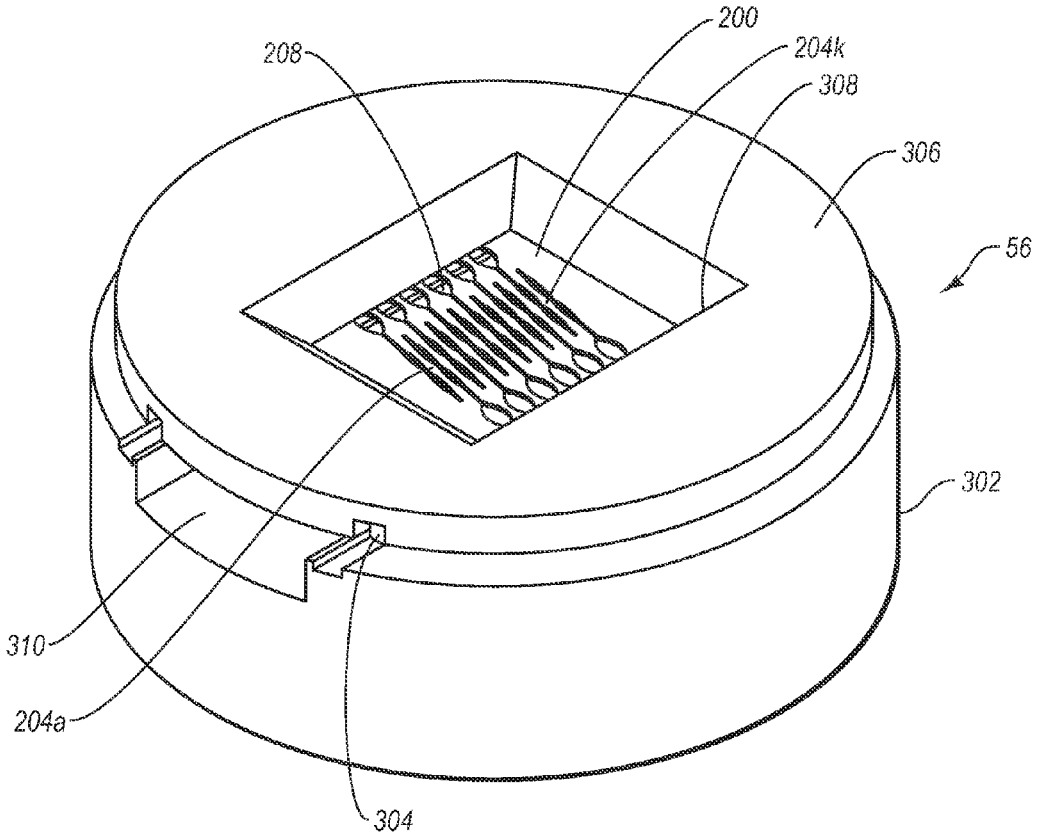
FIG. 4 illustrates a cathode head including an electron emitter assembly, according to one embodiment of the present invention.

Reference is now made to FIG. 4. FIG. 4 depicts one possible example of the installation of electron emitter assembly 200, wherein an electron emitter assembly 200 is shown disposed in a cathode head 56. The electron emitter assembly 200 includes a plurality rung segments 204*a*-204*k* as in previous embodiments. The electron emitter assembly 200 is disposed over a cavity 310 defined in cathode body 302 the cathode head 56. The emitter 200 is mounted on two thermally conductive insulators 304 that are disposed at opposite ends of the cathode head cavity 310. This provides electrical isolation of the electron emitter 200 with respect to the cathode head 56 while enabling heat sinking of the emitter assembly 200 with respect to the cathode head 56. The emitter 200 is coupled to the cathode head 56 by the cathode top 306 that includes focusing aperture 308.

Note that other cathode head and support structure implementations might also be used. One such example is disclosed in United States Patent Application entitled "Electron Emitter Apparatus and Method of Assembly," application Ser. No. 12/238,214, filed on Sep. 25, 2008, the contents of which are incorporated herein by reference.

When positioned in the manner illustrated in FIG. 4, the electron emitter assembly 200 is oriented to emit a stream of electrons when energized. Note that, though it is centrally located on the cathode head 56, the emitter 200 in other embodiments could be placed off-axis with respect to the cathode head center, if desired. This possibility exists with each of the embodiments described herein.

Each parallel rung segment 204*a*-204*k* is angled with respect to the side of the emitter and the focusing aperture 308, which is best seen in FIGS. 2A and 3A. At the perspective shown in FIG. 4, the electron emitter 200 is relatively flat with respect to the cathode head 56. In other embodiments, the emitter could be angled so as to project into or out of cavity 310.

The rung segments 204*a*-204*k* are interconnected with one another via a plurality of interconnections so as to place the segments in electrical series with respect to one another. Note that, though shown in electrical series here, the rung segments could alternatively be placed electrically in parallel, if desired.

Figure 5A:
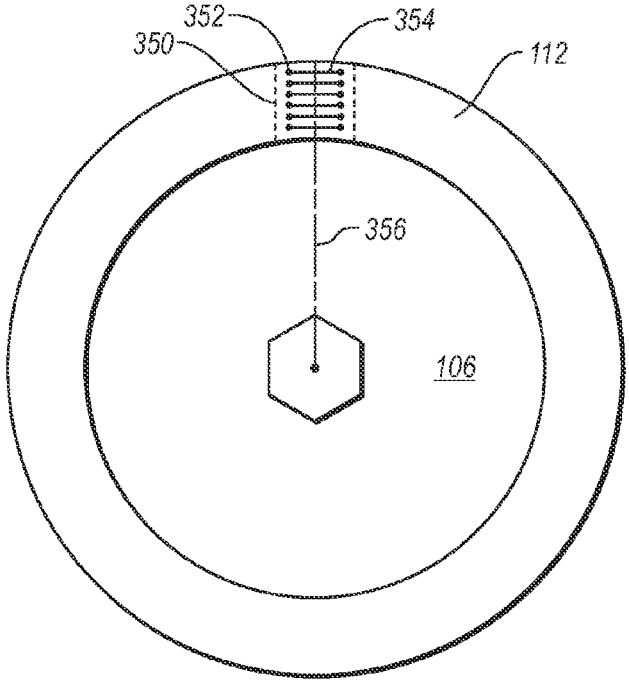
FIG. 5A illustrates a rotating target anode depicting a theoretical heating pattern produced by an emitter having a plurality of parallel emission surfaces, according to one embodiment of the present invention.
Figure 5B:
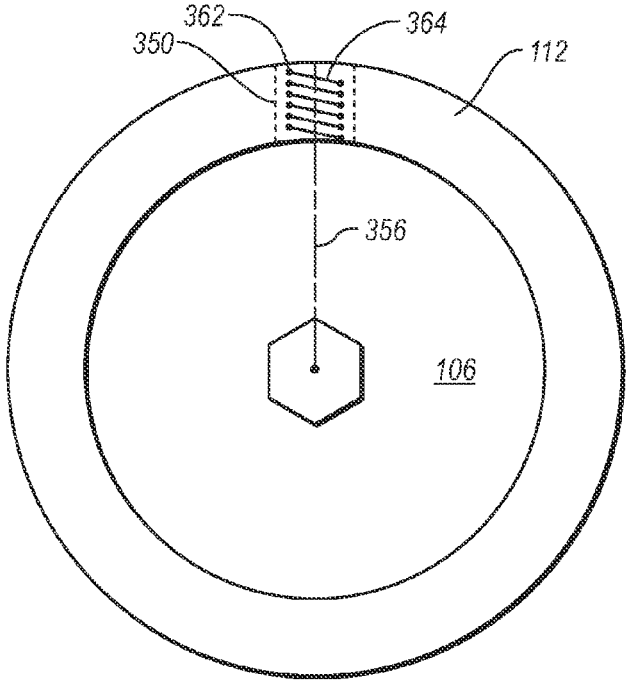
FIG. 5B illustrates a rotating target anode depicting a theoretical heating pattern produced by an emitter having a plurality of parallel emission surfaces, wherein the emission surfaces are angled relative to the directional vector of the rotating anode, according to one embodiment of the present invention.

Reference is now made to FIGS. 5A and 5B. FIG. 5A depicts a rotating anode 106 and a target surface 112 with a schematic projection of a heating pattern on the target surface 112 produced by a hypothetical non-angled emitter. FIG. 5B depicts a similar view with the schematic heating pattern produced by an angled emitter according to one embodiment of the present invention.

FIG. 5A shows a rectangular focal region 350 on target surface 112. The long axis of focal region 350 is parallel to a hypothetical radial line 356 drawn from the center of rotating anode 106 that bisects focal region 350. Focal region 350 contains a plurality of bands 354 that are produced by the parallel emission surfaces of the emitter. Bands 354 also include a plurality of hot spots (e.g., 352*a* and 352*b*). Bands 354 and hot spots 352 are parallel to the angle or rotation of the rotating anode 106.

In operation, the rotating anode is typically rotating at about 3000-10,000 rpm. At that rate of speed, bands 354 and hot spots 352 form a ladder-like arrangement of hotter and cooler stripes on the surface of the anode. As mentioned above, this banding pattern is undesirable for x-ray quality reasons. Moreover, hot spots 352 are arranged such that they overlap and produce an additive effect that limits the power that can be applied to the emitter without overheating the anode. This has a detrimental effect on the maximum intensity of the x-rays that can be produced.

FIG. 5B also depicts an example of a rotating anode 106 having a target surface 112. Projected onto target surface 112 is a rectangular focusing region 350 containing a plurality of bands 364 that are produced by the parallel emission surfaces of a hypothetical emitter. As in FIG. 5A, the long axis of focal region 350 is parallel to a hypothetical radial line 356 drawn from the center of rotating anode 106 that bisects focal region 350. In contrast to the embodiment depicted in FIG. 5A, the plurality bands 364 and the plurality of hot spots 362 are angled relative the focal region 350. The practical effect of the angling is that the plurality of hot spots 362 do not overlap, thus obviating the additive heat effect described in relation to FIG. 5A. Moreover, the angling of the plurality of bands 364 widens the bands 364 on the anode surface 112 to the point where they produce a favorable overlap. Band 364 overlap coupled with no overlap of the hot spots 362 smoothes out the thermal loading on the anode surface.

This allows the maximum power to be applied to the anode without resulting in thermal damage to the anode. This effect allows for maximum x-ray flux from the x-ray tube, which improves x-ray image contrast and shortens the amount of time need to collect a high quality x-ray image. A second effect is that the line shape function of the focal spot is also smoothed leading to a more desirable Modulation Transfer Function for sharper images.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electron emitter assembly, comprising:

a cathode head;

a focusing apparatus comprising a focusing aperture operatively coupled to the cathode head, the focusing aperture having at least a first and a second side edge, wherein at least one of the side edges defines an x-axis; and an electron emitter disposed in the cathode head relative to the focusing apparatus such that the focusing apparatus focuses a cloud of electrons emitted by the electron emitter into an electron beam, the electron emitter comprising:

a refractory metal electrical conduction element having a plurality of substantially parallel electron emission surfaces, wherein the plurality of substantially parallel electron emission surfaces are angled relative to the x-axis defined by the focusing apparatus.

2. An electron emitter assembly as recited in claim 1, the angle is in a range from about 5° to about 45°.

3. An electron emitter assembly as recited in claim 1, the angle is in a range from about 7.5° to about 35°.

4. An electron emitter assembly as recited in claim 1, the angle is in a range from about 10° to about 25°.

5. An electron emitter assembly as recited in claim 1, the angle is in a range from about 10° to about 15°.

6. An electron emitter assembly as recited in claim 1, wherein the refractory metal electrical conduction element is a refractory metal foil having a plurality of electron-emitting rungs defined by a plurality cut out slits, each rung having a middle portion and two end portions, the middle portion having a relatively wider cross-section than the end portions.

7. An electron emitter assembly as recited in claim 6, wherein the cross-section of each rung is selected to balance current flow, resistance, and thermal conduction such that a beam of electrons is collectively emitted from the rungs.

8. An electron emitter assembly as recited in claim 1, wherein the refractory metal electrical conduction element is a wire filament.

9. An electron emitter assembly as recited in claim 1, wherein the refractory metal electrical conduction element is fabricated from a metal selected from the group consisting of tungsten, thoriated tungsten, tungsten-rhenium, or lanthanated tungsten, hafnium, hafnium carbide, and combinations thereof.

10. An electron emitter assembly as recited in claim 9, wherein the refractory metal electrical conduction element further comprises a carbon dopant.

11. An electron emitter assembly, comprising:

a cathode head;

a focusing apparatus comprising a focusing aperture operatively coupled to the cathode head, the focusing aperture having at least a first and a second side edge, wherein at least one of the side edges defines an x-axis; and an electron emitter configured to emit electrons when heated by heating electrical current, the electron emitter being disposed in the cathode head such that the focusing apparatus focuses the electrons emitted by the electron emitter into an electron beam, the electron emitter comprising:

a substantially flat refractory metal foil having first and second side edges, and a plurality of electron-emitting rungs defined by a plurality cut out slits, each rung having a middle portion and two end portions; and a plurality of ellipsoidal cut-outs adjacent to the first and second edges at the ends of the rungs, wherein the ellipsoidal cut-outs are able to accommodate heat-induced expansion of the emitter such that the refractory metal foil remains substantially flat in operation.

12. An electron emitter assembly as recited in claim 11, wherein the plurality of rungs comprise a serpentine electrical conduction path.

13. An electron emitter assembly as recited in claim 12, wherein the rungs are electrically connected to one another in series.

14. An electron emitter assembly as recited in claim 12, wherein the ellipsoidal cut-outs are substantially isolated from the electrical conduction path.

15. An electron emitter assembly as recited in claim 11, wherein each rung further comprises a cross-section, the middle portion having a relatively wider cross-section than the end portions.

16. An electron emitter assembly as recited in claim 15, wherein the cross-section of each rung is selected to balance current flow, resistance, and thermal conduction such that a beam of electrons is collectively emitted from the rungs.

17. An electron emitter assembly as recited in claim 15, wherein the refractory metal foil is fabricated from a metal selected from the group consisting of tungsten, thoriated tungsten, tungsten-rhenium, or lanthanated tungsten, hafnium, hafnium carbide, and combinations thereof.

18. An electron emitter assembly as recited in claim 17, wherein the refractory metal foil further comprises a carbon dopant.

19. An electron emitter assembly, comprising:

a cathode head a focusing apparatus comprising a focusing aperture operatively coupled to the cathode head, the focusing aperture having at least a first and a second side edge, wherein at least one of the side edges defines an x-axis; and an electron emitter comprising a substantially flat emission surface, the electron emitter further comprising:

a refractory metal foil configured to emit electrons when heated by heating electrical current, the refractory metal foil comprising:

first and second side edges, wherein at least one of the first and second edges defines an x-axis;

a plurality of electron-emitting rungs defined by a plurality slits, each rung having a middle portion and two end portions; and a plurality of ellipsoidal cut-outs disposed between the first and second edges and the end portions of the rungs, wherein the rungs define an angle relative to the x-axis and relative to the focusing apparatus, and wherein the ellipsoidal cut-outs are able to accommodate heat-induced expansion of the emitter such that the refractory metal foil remains substantially flat in operation.

20. An electron emitter assembly as recited in claim 19, the angle is in a range from about 5° to about 45°.

21. An electron emitter assembly as recited in claim 19, the angle is in a range from about 10° to about 15°.

22. An electron emitter assembly as recited in claim 19, wherein the plurality of rungs comprise a serpentine electrical conduction path.

23. An electron emitter assembly as recited in claim 22, wherein the rungs are electrically connected to one another in series.

24. An electron emitter assembly as recited in claim 22, wherein the ellipsoidal cut-outs are substantially isolated from the electrical conduction path.

25. An electron emitter assembly as recited in claim 19, wherein each rung further comprises a cross-section, the middle portion having a relatively wider cross-section than the end portions.

26. An electron emitter assembly as recited in claim 25, wherein the cross-section of each rung is selected to balance current flow, resistance, and thermal conduction such that a beam of electrons is collectively emitted from the rungs.

27. An electron emitter assembly as recited in claim 19, wherein the refractory metal foil is fabricated from a metal selected from the group consisting of tungsten, thoriated tungsten, tungsten-rhenium, or lanthanated tungsten, hafnium, hafnium carbide, and combinations thereof.

28. An electron emitter assembly as recited in claim 27, wherein the refractory metal foil further comprises a carbon dopant.

29. An x-ray tube, comprising:

a vacuum enclosure;

an anode positioned within the vacuum enclosure and including a target surface;

an electron emitter assembly positioned with respect to the anode, the electron emitter assembly comprising:

a cathode head;

a focusing apparatus comprising a focusing aperture operatively coupled to the cathode head, the focusing aperture having at least a first and a second side edge, wherein at least one of the side edges defines an x-axis; and a substantially flat electron emitter disposed in the cathode head relative to the focusing apparatus such that the focusing apparatus focuses the electrons emitted by the electron emitter into an electron beam that impinges on the target surface for generation of x-rays, the electron emitter comprising:

a refractory metal foil having first and second edges; and a plurality of rungs defined by a plurality of slits cut out of the refractory metal foil, each rung having a middle portion and two end portions, wherein at least one of the first and second end portions of the refractory metal foil defines an x-axis, and wherein the rungs are angled relative to the x-axis and relative to the focusing apparatus in a range from about 5° to about 45° so as to provide for a substantially uniform heat profile on the target anode under impingement by the electron beam.

30. An x-ray tube as recited in claim 29, wherein the angle is in a range from about 7.5° to about 25°.

31. An x-ray tube as recited in claim 29, wherein the angle is in a range from about 10° to about 15°.

32. A cathode assembly as recited in claim 29, wherein the rungs are electrically connected to one another in series.

33. An x-ray tube as recited in claim 29, each rung further comprising a temperature profile having a plurality of hot spots, wherein the angle offsets the hot spots on each rung thereby providing for the substantially uniform heat profile of the target anode under impingement by the electron beam.

34. An x-ray tube as recited in claim 29, wherein the substantially uniform heat profile on the target anode provides for an increase in power that can be applied to the x-ray tube relative to an x-ray tube that does not provide for a substantially uniform heat profile on the target anode.

35. An x-ray tube as recited in claim 34, wherein increase in power provides for an increase in x-ray flux from the x-ray tube.

36. An x-ray tube as recited in claim 29, the plurality of rungs collectively emit a focused beam of electrons when the refractory metal foil is energized by a heating electrical current.

37. An x-ray tube as recited in claim 29, the refractory metal foil further comprising a plurality of ellipsoidal cut-outs disposed between the first and second edges and the end portions of the rungs, wherein the ellipsoidal cut-outs accommodate heat-induced expansion of the refractory metal foil caused by the heating electrical current such that the refractory metal foil remains substantially flat during emission.

38. An x-ray tube as recited in claim 37, wherein the plurality of rungs comprise a serpentine electrical conduction path.

39. An x-ray tube as recited in claim 38, wherein the ellipsoidal cut-outs are substantially isolated from the electrical conduction path.

40. An x-ray imaging device, comprising:

an x-ray detector; and an x-ray source, comprising:

a vacuum enclosure;

an anode positioned within the vacuum enclosure and including a target surface;

an electron emitter assembly spaced apart from the anode, the electron emitter assembly comprising:

a cathode head;

a focusing apparatus comprising a focusing aperture operatively coupled to the cathode head, the focusing aperture having at least a first and a second side edge, wherein at least one of the side edges defines an x-axis; and a substantially flat electron emitter disposed in the cathode head relative to the focusing apparatus such that the focusing apparatus focuses the electrons emitted by the electron emitter into an electron beam that impinges on the target surface for generation of x-rays, the electron emitter comprising:

a refractory metal foil having first and second edges; and a plurality of rungs interleaved with a plurality of slits cut out of the refractory metal foil, the rungs having a temperature profile and a plurality of hot spots that project onto the target anode, wherein at least one of the first and second edges of the refractory metal foil defines an x-axis, and wherein the rungs are angled relative to the x-axis and relative to the focusing apparatus in a range from about 5° to about 45° so as to offset the hot spots on each rung and the hot spots on adjacent rungs such that there is substantially no overlap of the hot spots.

41. An x-ray imaging device as recited in claim 40, wherein the rungs are arranged substantially parallel to one another between the first and second end portions.

42. An x-ray imaging device as recited in claim 40, wherein the angle of offset provides for a substantially uniform thermal profile on the target anode under the electron beam relative to an x-ray imaging device that does not provide for a substantially uniform heat profile on the target anode.

43. An x-ray imaging device as recited in claim 42, wherein the substantially uniform thermal provides for an increase in power that can be applied to the x-ray source.

44. An x-ray imaging device as recited in claim 43, wherein increase in power provides for an increase in x-ray flux from the x-ray source.

45. An x-ray imaging device as recited in claim 40, the refractory metal foil further comprising a plurality of ellipsoidal cut-outs disposed between the first and second edges and the end portions of the rungs, wherein the ellipsoidal cut-outs accommodate heat-induced expansion of the refractory metal foil caused by the heating electrical current such that the refractory metal foil remains substantially flat during emission.

46. An x-ray imaging device as recited in claim 45, wherein the plurality of rungs comprise a serpentine electrical conduction path.

47. An x-ray imaging device as recited in claim 46, wherein the ellipsoidal cut-outs are substantially isolated from the electrical conduction path.

48. An x-ray imaging device as recited in claim 40, wherein a beam of electrons is collectively emitted from the rungs.

49. An x-ray imaging device as recited in claim 40, wherein the refractory metal foil is fabricated from a metal selected from the group consisting of tungsten, thoriated tungsten, tungsten-rhenium, or lanthanated tungsten, hafnium, hafnium carbide, and combinations thereof.

50. An x-ray imaging device as recited in claim 40, wherein the refractory metal foil further comprises a carbon dopant.

* * * * *